US006317893B1

(12) United States Patent
Walton

(10) Patent No.: US 6,317,893 B1
(45) Date of Patent: Nov. 20, 2001

(54) BREATHABLE WADERS WITH INTERCHANGEABLE INSULATED LININGS

(75) Inventor: Gerald Clayton Walton, Mineral Wells, TX (US)

(73) Assignee: Stearns Inc., Sauk Rapids, MN (US)

( * ) Notice: Subject to any disclaimer, the term of this patent is extended or adjusted under 35 U.S.C. 154(b) by 0 days.

(21) Appl. No.: 09/686,117

(22) Filed: Oct. 11, 2000

(51) Int. Cl.[7] ..... A41D 13/00
(52) U.S. Cl. ..... 2/227; 2/69; 2/82
(58) Field of Search ..... 2/82, 81, 242, 2/227, 69.79; 36/4, 2 R, 1.5, 2 B, 109

(56) References Cited

U.S. PATENT DOCUMENTS

| | | | | |
|---|---|---|---|---|
| Re. 34,662 | * | 7/1994 | Keller | 2/82 |
| 2,533,453 | | 12/1950 | Gottschalk . | |
| 4,599,812 | | 7/1986 | Haramsen . | |
| 4,809,447 | | 3/1989 | Pacanowsky et al. . | |
| 4,858,342 | | 8/1989 | Nicholson et al. . | |
| 4,912,860 | * | 4/1990 | Keller | 2/82 |
| 4,984,377 | | 1/1991 | Schneider . | |
| 5,022,096 | | 6/1991 | Pacanowsky . | |
| 5,067,260 | | 11/1991 | Jenkins, Jr. . | |
| 5,081,718 | * | 1/1992 | Carman et al. | 2/227 |
| 5,210,879 | | 5/1993 | Miller . | |
| 5,711,031 | * | 1/1998 | Clement | 2/82 |
| 5,724,680 | | 3/1998 | Cesnick et al. . | |
| 5,867,828 | * | 2/1999 | Shih | 2/82 |
| 5,896,676 | | 4/1999 | Barousse . | |
| 5,901,374 | * | 5/1999 | Foster | 2/82 |
| 6,154,884 | * | 12/2000 | Dehner | 2/69 |
| 6,167,571 | * | 1/2001 | Cheng | 2/227 |

* cited by examiner

*Primary Examiner*—Gloria M. Hale
(74) *Attorney, Agent, or Firm*—Merchant & Gould P.C.

(57) ABSTRACT

An improved liner system for uninsulated waders is disclosed. Pant-like liners of various weights and insulating properties are configured for operative insertion within a lightweight uninsulated wader shell, particularly of the breathable type. The wearer can select that liner having the proper insulating properties for the use to which the waders will be put. A simple fastening system allows the liners to be rapidly installed and/or replaced in the waders. The liner fasteners are preferably placed adjacent the upper peripheral edge and the lower legging edges of the liner and mate with corresponding fasteners secured to the inside of the wader shell.

21 Claims, 3 Drawing Sheets

10
12
12a
12b
12c
14
15
15a
16
17a
17b
18a
18b
19a
19b
20a
20b
22
23
24
30
31
32
33
34
40
42
43
45

BREATHABLE WADERS WITH INTERCHANGEABLE INSULATED LININGS

BACKGROUND OF THE INVENTION

1. Field of the Invention

This invention relates generally to waders, and more particularly to an improved construction for waterproof breathable waders.

2. Description of the Prior Art

Waders used by fishermen and hunters are well-known in the art. They essentially comprise waterproof pants that usually extend above the wearer's waist up to mid chest level and are supported and carried by the wearer by means of suspenders. The lower leg portions of the waders are typically integrally attached to a shoe or boot or sock or bootie, to form a unitized waterproof garment for the lower body portion of the wearer.

Early wader configurations were made from gas impermeable materials such as rubber. Such materials were generally heavy, making them cumbersome to use and did not provide any ventilation to the wearer, thereby causing discomfort to the wearer due to moisture accumulation within the wader. Such moisture accumulation results in a clammy feeling and can contribute to chaffing between the interior surfaces of the wader and the skin of the wearer. A further disadvantage of the materials such as rubber used in such typical commercially available waders is that such materials have a tendency to deteriorate and readily abrade.

With the commercialization of breathable film materials such as polytetrafluoroethylene (PTFE) and hydrophilic coatings which provide for water impermeability in one direction but vapor permeability in the other, a number of lightweight waterproof yet breathable materials have been developed. Such breathable materials have become commonplace in outerwear clothing such as jackets, gloves and the like. They have also been used to construct waterproof breathable waders, such as described and illustrated in U.S. Pat. No. 5,022,096. Such breathable wader configurations provide significant advantages in reducing the overall weight of the wader material and allow the material to breathe, providing enhanced use flexibility and increased comfort to the wearer. Such materials also enable the wader shell to be constructed of more durable and abrasion resistant materials than the previously used rubber materials.

One problem associated with the use of such light weight breathable materials is that such materials readily conduct the external water temperature to the wearer, requiring the use of some type of insulating liner within the outer wader shell to provide comfort to the wearer against cold and varying water temperatures and to provide additional structural support to the wader shell. Prior breathable wader configurations have incorporated a single standard insulative liner within the outer wader shell. Such liner has typically been bonded or laminated to the outer shell, thus providing only one level of insulation and warmth to the wearer. Such liners are typically of a weight that does not adequately insulate against frigid water temperatures, and which may provide too much insulation against warm water temperatures. In order to adapt the wader for use in waters of varying temperatures, the wearer has had to dress appropriately for the particular water temperature with which the wader is to be used, by donning insulative garments of appropriate weight.

Accordingly, there is a need for a breathable waterproof wader having a construction and configuration which allows for interchangeability of inner liners to accommodate the water temperatures with which the waders will be used. The present invention addresses this need.

SUMMARY

This invention provides a detachable lining system for waders that is particularly applicable for use with uninsulated waders having thin breathable material. The lining system provides liners of varying weight and insulative properties that can be readily inserted and attached to, or unattached and removed from the waders by means of simple fastener mechanisms. For example, a warm quilted insulative liner can be operatively fastened to the wader shell to accommodate use of the waders in relatively cold water conditions; whereas a lighter-weight fleece lining could be fastened to the waders for use in relatively warmer water conditions. Obviously, the liners can also be rapidly replaced in the outer shell for other reasons as well, such as in the event of wear or damage to the liner.

Therefore, according to one aspect of the invention there is provided a lining system for uninsulated waterproof waders of the type having an outer pant-shaped shell with integrally connected socks, comprising: (a) a liner of insulating material configured in pants-like shape and sized to matingly cooperatively fit within the outer wader shell, the liner having an upper portion terminating at an upper peripheral edge and being sized to encircle the upper torso of a person, and a pair of leg portions downwardly depending from the upper portion and terminating at lower edges and configured to extend to the lower legs or ankles of a person; (b) an upper fastener having one part thereof connected to the liner adjacent its upper peripheral edge and a second mating part thereof mounted to an inside surface of the outer shell, for detachably securing the upper portion of the liner to the outer shell; and (c) a lower fastener having one part thereof connected to each of the leg portions of the liner and adjacent the lower edges thereof, and a second mating part thereof mounted to an inside surface of the outer shell, for operatively detachably securing the leg portion to the outer shell. According to one embodiment of the invention, the liner comprises fleece material. According to another embodiment, the liner comprises quilted insulative material. According to one aspect of the invention, the upper fastener member comprises a zipper. However, it will be understood by those skilled in the art that other fastener materials could be used. In similar fashion, according to a preferred embodiment of the invention, the lower fastener comprises a zipper or a hook and loop type fastener. However, other fastener members could also be used within the spirit and intent of this invention.

According to another aspect of the invention there is provided a pair of waders, comprising: (a) an outer waterproof shell of unlined material configured in pants-like shape; (b) a pair of sock members sealingly connected to lower extremities of leg portions of the outer shell; and (c) a pants-like liner configured for removable insertion within the outer shell. The outer shell preferably comprises a lightweight breathable, yet waterproof material. The liner is preferably detachably secured to the outer shell by means of one or a plurality of fastener members such as zippers or hook and loop fasteners. Preferably one such fastener secures the upper peripheral edge of the liner adjacent the upper end of the waders, and second fasteners secure the lower leg portions of the liner to the wader outer shell at or adjacent the sock portions of the waders. The waders may include additional features such as an external belt for cinching the waders about the wearer's body, protective knee pads, suspenders, pockets, additional padding, and the like.

While the present invention will be described with respect to a particular wader shell configuration, it will be understood by those skilled in the art that other shell configurations could be used. Further, while the invention is described with respect to a particular type of lightweight, breathable wader material, those skilled in the art will readily recognize the applicability of the invention to other types of waterproof materials. Further, while several specific types of liners and liner materials area illustrated with respect to the preferred embodiments of the invention, those skilled in the art will recognize the applicability of the invention to yet other types of liners and liner materials. Further, while particular types of fasteners and their relative locations relative to the outer shell and liner materials are illustrated, it will be appreciated that the invention is not limited to the specific types of fasteners disclosed or their positions as illustrated in the preferred embodiments. These and other features of the invention will become apparent to those skilled in the art upon a more detailed description of the invention.

BRIEF DESCRIPTION OF THE DRAWINGS

Referring to the Drawing, wherein like numerals represent like parts throughout the several views.

DETAILED DESCRIPTION OF THE PREFERRED EMBODIMENT

Figures 1, 2, 3:
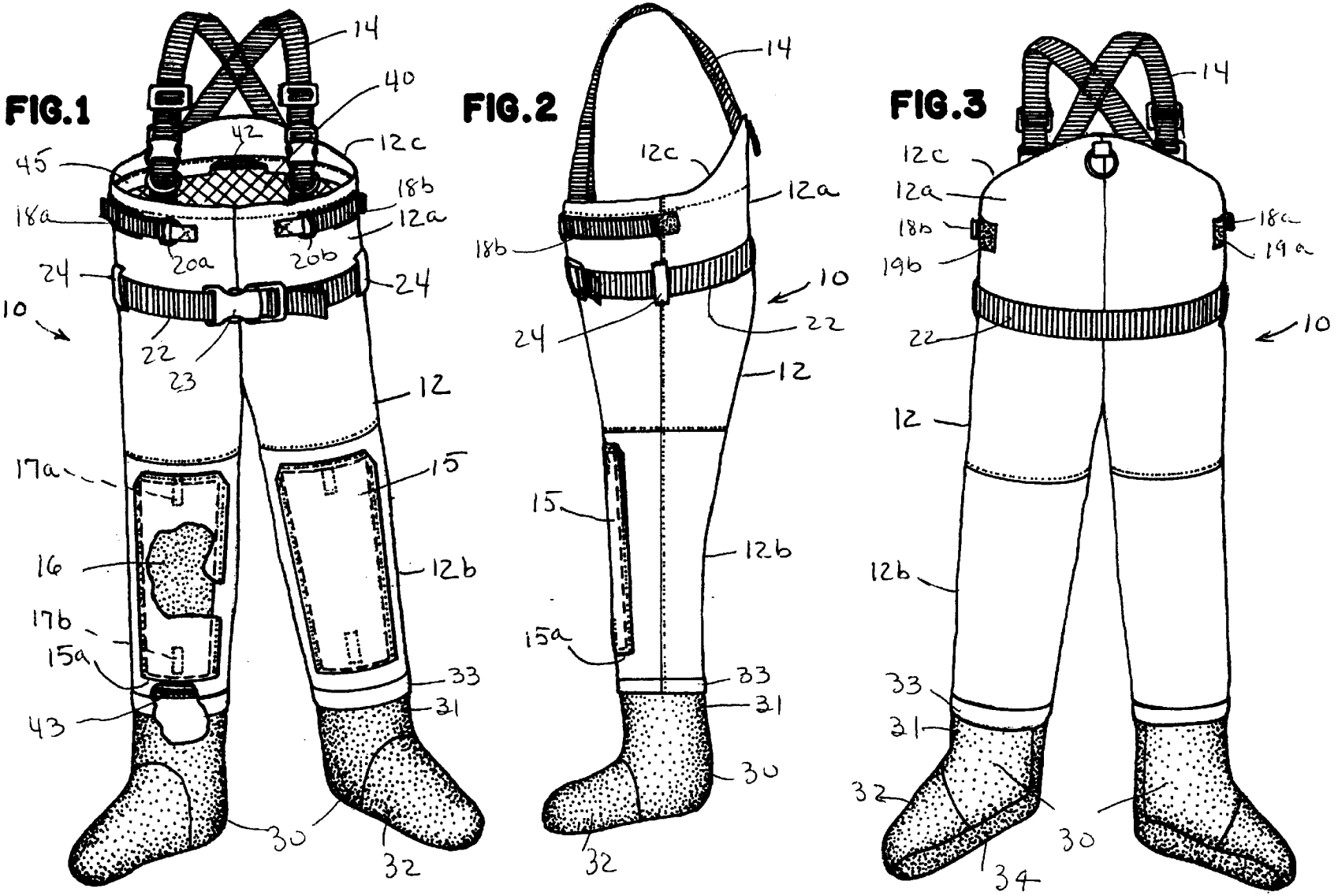
FIG. 1 is a front perspective view of a pair of waders configured according to the principles of this invention, illustrating a first embodiment of a removable liner.
FIG. 2 is a side elevational view of the waders of FIG. 1.
FIG. 3 is a rear elevational view of the waders of FIG. 1.

The present invention provides a wader configuration that provides for comfortable use in all four seasons. The wader configuration includes an outer pants and chest protection portion of lightweight waterproof and breathable material connected to a pair of waterproof socks, booties or boots, and a plurality of removable liners of varying weights and insulating properties for accommodating a wide range of external water temperatures.

Referring to the figures, a first embodiment of a wader configuration constructed according to the principles of this invention is generally illustrated at 10 in FIG. 1–6. Referring thereto, the waders have an outer shell pants portion 12 comprising an upper portion 12*a* and a pair of leg portions 12*b* downwardly depending therefrom in typical pants-like manner. The upper portion 12*a* of the outer shell 12 is configured to surround the abdomen, buttocks and lower torso and chest portions of a person. The upper portion 12*a* of the outer shell is sized such that its upper edge 12*c* generally extends to the mid or upper chest level of a wearer. The upper edge 12*c* of the waders forms a closed surface defining an upper wader access opening, generally designated at 13.

The outer shell pants portion 12 is constructed of a waterproof yet breathable material, generally of laminar construction (such as GIIXT material sold under the Entrant™ mark of Toray International Inc.). The outer shell could be constructed in a wader configuration in any well-known manner, such as for example of the type described in U.S. Pat. No. 5,022,096, herein incorporated by reference to the extent that its disclosures are necessary to an understanding of this invention. It will be understood by those skilled in the art, that other known materials and constructions of the outer shell material and the wader configuration made therefrom could be used. In the preferred embodiment, the outer shell material comprises a lamination of two or three layers of nylon material bonded together to form a unitized laminated fabric material with a hydrophilic coating that is waterproof or impermeable to liquids present external of the waders, while being permeable to vapors, allowing the material to "breathe". Alternatively, a layer of microporous membrane material such as PTFE could be used. Such breathable materials enable vapors such as those caused by perspiration and the like to pass through the fabric from the inside of the waders, while preventing external liquids from entering the inner cavity of the waders. In the preferred embodiment, the outer shell material has a thickness of from about 0.30 mm to 1.25 mm, providing a very lightweight material that enables ease of movement, while also providing good adequate physical protection.

A pair of suspenders 14 are secured to the outer shell pants portion adjacent the upper edge 12*c* thereof, enabling support of the waders from the shoulders of a person, in manner well-known in the art. In the preferred embodiment, the suspenders are constructed of elastic webbing material approximately 1½ inches wide.

Each of the leg portions 12*b* of the outer shell defines a pocket 15 located on the front or forward facing portion of the leg member and longitudinally spaced therealong so as to generally align with the knee of a wearer of the waders. The external openings 15*a* to the pockets 15 are, in the preferred embodiment, located at the lowermost edge of the pocket to provide for drainage of any liquid entering the pocket. A pad of neoprene material 16 is sized and configured to be cooperatively received by and held within each of the leg pockets 15 and is removably secured within the pocket by means of a pair of upper and lower spaced fasteners 17*a* and 17*b*. In the preferred embodiment, the fasteners 17 are of a hook and loop construction such as sold under the Velcro® trademark.

Figure 5:
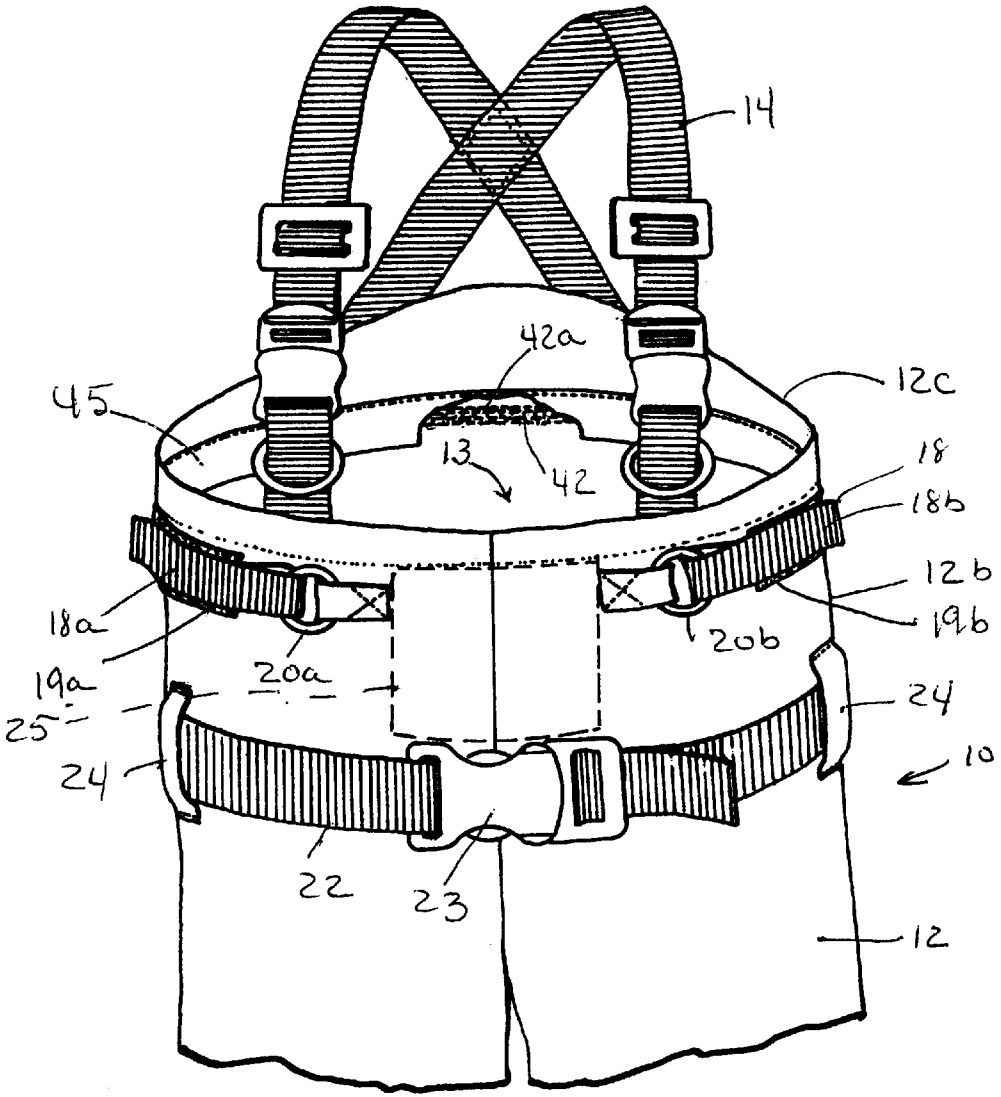
FIG. 5 is a fragmentary top front perspective view of the outer shell portion of the waders of FIG. 1, illustrated with the removable liner portion removed.

In the preferred embodiment, the waders 10 include a pair of cincture or tightening assemblies mountable to the upper portion 12*a* of the outer shell 12 enabling the upper portion 12*a* to be drawn toward and tightened around the wearer's body at various longitudinal positions therealong. A first such tightening assembly 18 is formed from a pair of strap portions 18*a* and 18*b*. The straps 18*a* and 18*b* each has a first end thereof sewn to the back side of the outer shell of the waders in circumferential alignment, as generally illustrated in FIG. 3. The straps 18*a* and 18*b* extend forward (toward the front of the waders) from their secured ends and toward their respective free or distal ends. A pair of D-rings 20*a* and 20*b* are secured to the outer wader shell on opposite side portions thereof and in alignment with the straps 18*a* and 18*b* as shown in FIGS. 1, 2 and 5. The strap segments 18*a* and 18*b* are entrained respectively through the D-rings 20*a* and 20*b* and are looped back on themselves in overlapping manner for adjustable fastening by means of a pair of fasteners 19*a*, 19*b*. The fasteners 19*a*, 19*b* are, in the preferred embodiment hook and loop type fasteners such as sold under the Velcro® mark, each having a first portion secured to the outer surface of the strap segments 18 overlying the secured end and a second mating portion secured to the outer surface of the strap segments adjacent their distal ends, such that when the strap segments are folded back on each other they can be adjustably secured at infinite positions therealong. The function of the adjustable strap segments 18 is to enable tightening of the upper edge portion 12*c* of the waders soas to close the upper wader access opening 13 about the chest portion of the wearer, while maintaining a generally wrinkle-free condition along the frontal surface area of the upper portion 12*a* of the waders. While in the preferred embodiment, the fastener 19 is of a hook and loop configuration; however, those skilled in the art will appreciate that other types of fasteners could equally well be used. In the preferred embodiment, the first belt member 18 is formed from a web belting material of a type well-known in the art, and is approximately 1½ inches wide.

A second tightening member in the form of a belt 22 is configured to encircle the upper portion 12*b* of the wader shell at a position generally corresponding to the waist of the wearer. The belt 22 is detachably secured to the outer shell of the wader by means of a pair of loops 24 which in the preferred embodiment, are sewn to the outer shell and are formed of the same material used to construct the outer shell. A fastener, in the form of a buckle 23 is mounted to the belt 22 at one end thereof, enabling the other end of the belt to be entrained therethrough and secured at infinitely adjustable positions therealong, in a manner well-known in the art. The belt 22 enables tightening of the upper portion 12*a* of the waders about the waist of the wearer to provide additional comfort to the wearer.

The outer shell 12 may also be equipped with other features of types well-known in the art. For example, waders typically include a pocket mounted to the inner surface of the outer shell pants portion 12 generally along the upper edge 12*c*, and extending downwardly therefrom. A pocket of this type is generally indicated at 25 (FIG. 5). The pocket includes a zipper or other appropriate closure member 26 located on the forward facing surface of the pocket, to enable access to the pocket 25 when the pocket is rotated in an upwardly extending manner soas to extend above the upper edge 12*c* of the outer wader shell. Such zipper location also provides additional comfort to the wearer, since the zipper does not come into contact with the wearer when the pocket is downwardly inserted into the outer liner. The waders may also include padding to provide additional comfort at various locations throughout the waders, other than the knee pads, such as the upper back pad member 28 illustrated in FIG. 3.

Each of the leg portions 12*b* of the outer shell pants is connected by sewing along its lower peripheral edge to the upper peripheral edge of a sock member 30. Each sock member has an upper cylindrical portion 31 designed to encircle the lower leg and ankle portions of the wearer, and a lower and front portion 32 configured to engage the foot and toe portions of the wearer. The upper and lower portions 31 and 32 respectively of the sock 30 are sewn together along a seam, generally indicated at 33. The upper portion 31 and the lower front portion 32 of the sock are made from a very stretchable neoprene material which enables ease of foot entry and egress from the sock, and also provides a measure of comfort to the wearer thereof. A strip of less stretchable reinforcing material 34 extends from the upper edge of the sock, down along the back surface thereof and continues forward to form the sole of the sock. In the preferred embodiment, the strip comprises a 3 mm thick panel of hypalon material. The upper peripheral edge of the socks 30 are secured to the lower peripheral edges of the pant leg portions 12*b* of the upper outer shell member 12 by stitching, in a manner well-known in the art. All seams are appropriately sealed by waterproof tape or the like, as for example, described in the referenced U.S. Pat. No. 5,022,096.

Figure 4:
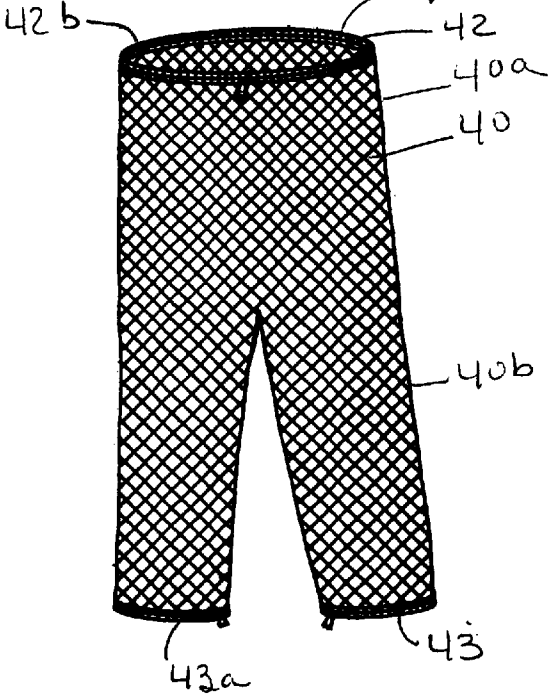
FIG. 4 is a front perspective view of the first embodiment of a removable liner of the waders of FIG. 1.

The outer shell pants portion 12 of the waders is configured to accommodate and detachably mount an inner liner member for lining and insulating the shell pants portion 12. A first embodiment of such a liner is generally illustrated at 40 in FIGS. 1–6. The first embodiment of the removable liner 40 is illustrated by itself, and detached from the outer shell pants portion 12, in FIG. 4. The liner 40 is of generally the same size and configuration of the outer shell pants portion 12, but sized slightly smaller than the outer shell so that it can cooperatively fit within the outer shell. The liner generally has an upper portion 40*a* and a pair of leg portions 40*b* downwardly depending therefrom. The upper portion 40*a* terminates at an upper edge indicated at 40*c*. In the preferred embodiment, the liner 40 is detachably secured to the outer shell pants portion 12 by means of upper and lower fastener members. In the first preferred embodiment illustrated in FIGS. 1–6, these fastener members take the form of upper and lower zippers 42 and 43 respectively. The upper zipper has a first zipper toothed portion 42*a* secured to the inner surface of the upper shell portion 12*a* in circumferential manner at a position adjacent to but spaced slightly downwardly from the upper edge 12*c* of the outer shell, as illustrated in FIGS. 1 and 5. A second mating toothed portion 42*b* of the zipper 42 is circumferentially secured adjacent the upper edge 40*c* of the liner 40 as illustrated in FIG. 4 soas to cooperatively align and mate with the first zipper portion 42*a*. The opposed ends of the zipper 42 meet adjacent the front of the waders. A protective flap member 45 is mounted to and extends downwardly from the upper edge 12*c* of the outer shell portion 12 along the inner surface thereof and is sized soas to extend over the zipper 42 to protect the wearer from direct engagement with the zipper 42. In the preferred embodiment, the zipper 42 is a 1 inch #5 nylon zipper, and the zipper protector flap is a 2 inch strip of 3 mm neoprene material.

The lower edges of the leg portions 40*b* of the liner 40 are, in the first preferred embodiment, secured to the inner surfaces of the upper edges of the socks 30 by means of a second or lower zipper 43. A first toothed member 43*a* of the zipper 43 is secured to the lower peripheral edges of the liner leg portions 40*b*. A second mating toothed member 43*b* of the zipper 43 is secured to the inner surface of the sock 30. Alternatively, the zipper segment 43*b* could be secured to the inner surface of the lower portion of the legs 12*b* of the outer shell member 12. In the preferred embodiment, the lower zipper 43 is a #3 nylon zipper.

It will be appreciated that the material forming the liner member 40 can be varied to provide the desired insulative properties for the wader. The readily detachable nature of the liner enables one liner to be rapidly removed from the wader and replaced with another having an insulative property that is calculated to counteract the temperature of the water with which the waders will be used. For example, a preferred liner material that offers high insulating properties is a fleece liner of double brushed material of 300 gram weight. Other liners such as those made of quilt materials wherein the insulating material is placed between two layers of nylon and quilt stitched in place, may be used. An example of such material is the 100 gram quilt material sold by the Minnesota Mining and Manufacturing Company under its Thinsulate™ trademark.

Figure 8:
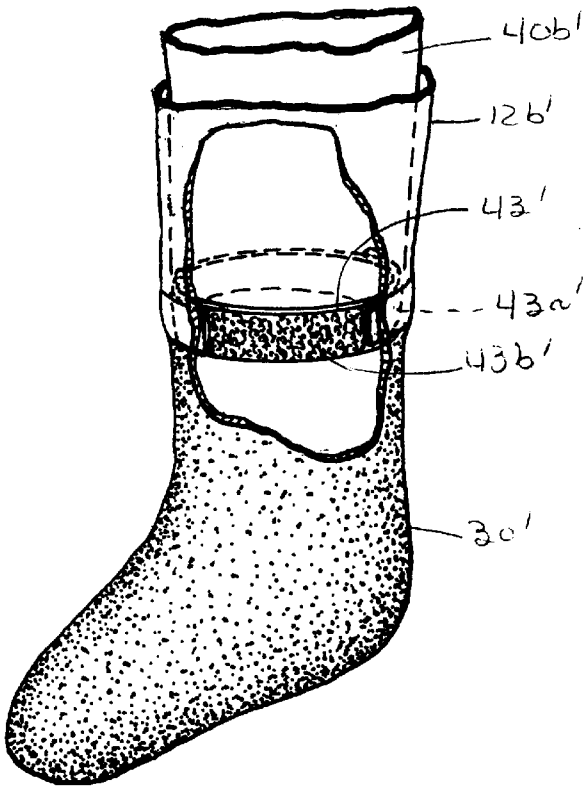
FIG. 8 is an enlarged fragmentary perspective view of one of the lower leg portions of the waders of FIG. 1, illustrating the connection between the inner liner of FIG. 7 and outer shell of FIG. 5.
Figure 7:
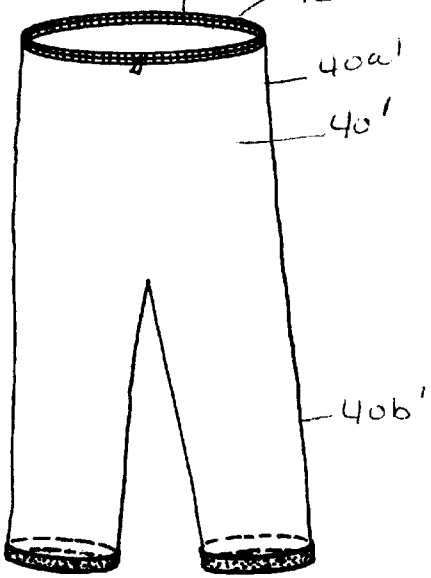
FIG. 7 is a front perspective view of a second embodiment of a removable liner that can be used with the outer shell of FIG. 5.
Figure 6:
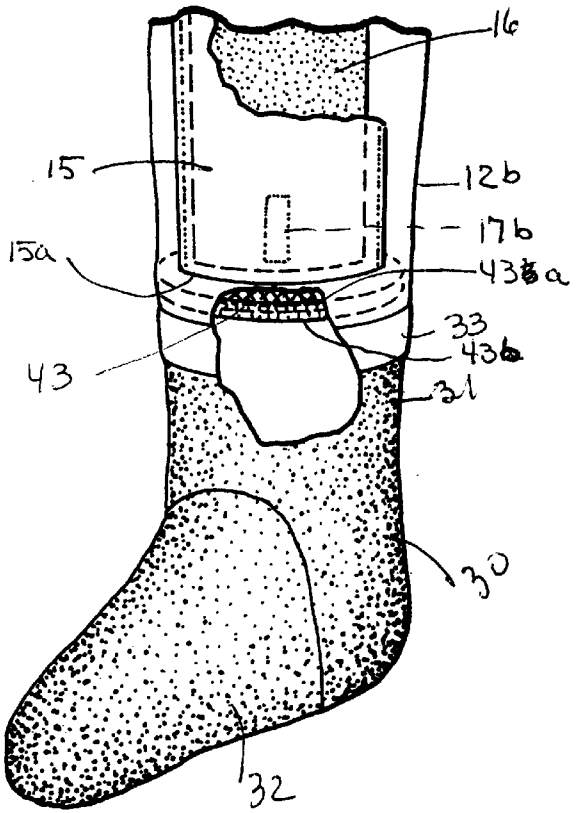
FIG. 6 is an enlarged fragmentary perspective view of one of the lower leg portions of the wader of FIG. 1, illustrating the connection between the inner liner and outer shell portions of the waders.

It will be appreciated that other fastener configurations can be configured within the spirit and intent of this invention, to detachably secure the inner liner member 40 to the outer shell 12. A second example of an alternative fastening configuration is illustrated in FIGS. 7 and 8, where the liner member is generally designated at 40's. For ease of description, similar parts of the second embodiment of the liner and waders illustrated in FIGS. 7 and 8, as compared to those of the first embodiment illustrated in FIGS. 1–6, will be indicated by the same reference numerals previously used for like parts, followed by a prime (') designation. It will be noted that the liner 40' of the second embodiment also utilizes an upper zipper fastener 42' similar to zipper 42, but that the lower edges of the liner leg portions 40*b*' are secured to the inside surfaces of the portions 12*b*' of the outer shell 12' by means of hook and loop fasteners 43'. In the preferred configuration of the second embodiment of the liner, the first portion 43*a*' of the fastener 43' comprises a strip of hook or loop material sewn to the outer surfaces of the leg portions 40*b*' adjacent their lower edges. The second portion 43*b*' of the fastener 43' comprises one or more hook or loop fastener patch members sewn to the inside of each of the wader leg portions 12*b*' in longitudinal mating alignment with the first fastener portions 43*a*'. These and other fastening configurations will be readily appreciated by those skilled in the art.

To secure the liner 40 to the outer shell portion 12, the liner is simply inserted into the outer shell through the upper wade access opening 13, leg portions 40*b* first, until the lower edges of the leg portions 40*b* and their respective fasteners align with the mating fasteners on the sock or lower leg portions of the outer shell. The lower fasteners 43 are then matably engaged to secure the leg portions 40*b* of the liner 40 in place relative to the outer shell 12. The upper edge 40*c* of the liner is then lifted until the mating parts of the upper fastener 42 are aligned. The matable parts of the fastener 42 are then secured to another, thereby securing the liner in operative position within the outer shell 12. The zipper flap 45 is then lowered in operative position overlying the upper zipper 42. To remove the liner from the shell, the process is simply reversed.

The above specification, examples and data provide a complete description of the configuration and use of preferred embodiments of the invention. Since many embodiments of the invention can be made without departing from the spirit and scope of the invention, the invention resides in the claims hereinafter appended which are not intended to be limited by the disclosures of any of the preferred embodiment examples illustrated herein.

What is claimed is:

1. A lining system for uninsulated waterproof waders of the type having an outer pant-shaped shell with integrally connected socks, comprising:

a. a liner of insulating material configured in pants-like shape and sized to matingly cooperatively fit within the outer wader shell, said liner having an upper portion terminating at an upper peripheral edge and sized to encircle the upper torso of a person, and a pair of leg portions downwardly depending from said upper portion and terminating at lower edges and configured to extend to the lower legs or ankles of a person;

b. an upper fastener having one part thereof connected to said liner adjacent said upper peripheral edge, and a second mating part thereof mounted to an inside surface of said outer shell, for detachably securing the upper portion of said liner to said outer shell; and c. a lower fastener having one part thereof connected to each of said leg portions adjacent said lower edges thereof, and a second mating part mounted to an inside surface of said outer shell for operatively detachably securing said leg portions to said outer shell.

2. The lining system of claim 1, wherein said liner comprises fleece material.

3. The lining system of claim 1, wherein said liner comprises quilted insulating material.

4. The lining system of claim 1, wherein said upper fastener comprises a zipper.

5. The lining system of claim 4, wherein said lower fastener comprises a zipper.

6. The lining system of claim 1, wherein said lower fastener comprises a zipper.

7. The lining system of claim 1, wherein said lower fastener comprises a hook and loop fastener.

8. A pair of waders, comprising:

a. an outer waterproof shell of unlined material, configured in pants-like shape;

b. a pair of sock members sealingly connected to lower extremities of leg portions of the outer shell; and c. a pants-like liner configured for removable insertion within the outer shell.

9. The pair of waders as recited in claim 8, wherein said outer shell comprises lightweight breathable material.

10. The pair of waders as recited in claim 8, including at least one fastener for detachably operatively securing said liner to said outer shell.

11. The pair of waders as recited in claim 10, wherein said fastener comprises a zipper.

12. The pair of waders as recited in claim 10, wherein said fastener comprises a first fastener positioned to secure the liner adjacent an upper edge thereof to the outer shell.

13. A pair of waders as recited in claim 12, further including a protective member overlying said first fastener along an inside surface of said outer shell, to protect a wearer of said waders from direct engagement with said first fastener.

14. The pair of waders as recited in claim 10, including a second fastener operatively positioned to secure the lower leg portions of said liner to said outer shell.

15. The pair of waders as recited in claim 14, wherein said second fastener comprises a zipper.

16. A pair of waders as recited in claim 14, wherein said second fastener comprises a hook and loop fastener.

17. The pair of waders as recited in claim 8, wherein said liner comprises fleece material.

18. The pair of waders as recited in claim 8, wherein said liner comprises quilted insulating material.

19. The pair of waders as recited in claim 8, further including at least one belt operatively mounted to the outer shell for tightening said waders about the body of a wearer.

20. The pair of waders as recited in claim 8, wherein the waders include protective knee pads.

21. The pair of waders as recited in claim 8, including suspenders operatively connected to the outer shell, adapted to secure the waders from the shoulders of a wearer.

* * * * *